US008485852B2

(12) United States Patent
Wu

(10) Patent No.: US 8,485,852 B2
(45) Date of Patent: Jul. 16, 2013

(54) WIRE LOCKING STRUCTURE

(75) Inventor: Shang Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 0 days.

(21) Appl. No.: 13/293,638

(22) Filed: Nov. 10, 2011

(65) Prior Publication Data

US 2013/0122756 A1 May 16, 2013

(51) Int. Cl.
*H01R 4/36* (2006.01)

(52) U.S. Cl.
USPC ..... 439/814

(58) Field of Classification Search
USPC ..... 439/814, 810, 813
See application file for complete search history.

(56) References Cited

U.S. PATENT DOCUMENTS

| | | | | |
|---|---|---|---|---|
| 3,742,431 | A * | 6/1973 | Kobryner | 439/814 |
| 7,086,900 | B2 * | 8/2006 | Comini | 439/598 |
| 2011/0189901 | A1 * | 8/2011 | Lopez et al. | 439/814 |

* cited by examiner

*Primary Examiner* — Gary F. Paumen
(74) *Attorney, Agent, or Firm* — Muncy, Geissler, Olds & Lowe, PLLC

(57) ABSTRACT

A wire locking structure includes a base, at least one conductive terminal lug and at least one screw. The base has at least one hole and at least one through-hole which communicate with each other and communicate with the outside of the base. The at least one conductive terminal lug is disposed at the at least one hole, includes a locking portion and a terminal portion, and has an aperture. The locking portion has an internal thread. The terminal portion extends from the at least one hole to the outside of the base. The aperture communicates with the at least one through-hole and opens to the internal thread. The at least one screw penetrates the at least one hole so as to be engaged with the internal thread and screwed into the aperture. The wire locking structure saves materials, cuts costs, and enhances the wire locking conforming rate.

5 Claims, 5 Drawing Sheets

WIRE LOCKING STRUCTURE

BACKGROUND OF THE INVENTION

1. Field of the Invention

The present invention relates to wire locking structures, and more particularly, to a wire locking structure that saves materials, cuts costs, and enhances the wire locking conforming rate.

2. Description of the Related Art

In general, electrical wirings in electronic devices are usually clamped and locked in place with wire locking structures, and then the electrical wirings are electrically connected to terminals electrically connected to the wire locking structure or other electronic components.

Referring to FIG. 1, there is shown a cross-sectional view of a conventional wire locking structure. As shown in the diagram, a conventional wire locking structure 9 comprises a base 91, a box-like body 92, a terminal 93, and a screw 94. The box-like body 92 is disposed in the base 91. The terminal 93 extends from below the box-like body 92. The screw 94 is screwed to the box-like body 92.

A wire locking process performed on an electrical wiring 95 entails the steps of: inserting the electrical wiring 95 into a hole 911 of the base 91; inserting the electrical wiring 95 into an opening 921 of the box-like body 92; and screwing the screw 94 in place. In the screwing step of the wire locking process, the screwing of the screw 94 causes the box-like body 92 to move upward, and in consequence the box-like body 92 clamps the electrical wiring 95 to thereby effectuate the purpose of wire locking.

However, as described above, the conventional wire locking structure 9 is structurally complicated, has a plethora of parts, causes a waste of materials, and incurs high costs.

In addition to the aforesaid drawbacks, the conventional wire locking structure 9 has a technical drawback, that is, with the box-like body 92 being driven by the screw 94 to move upward for clamping the electrical wiring 95, the electrical wiring 95 is likely to bend, thereby increasing the non-conforming rate of wire locking. Accordingly, it is imperative to improve the conventional wire locking structure 9.

SUMMARY OF THE INVENTION

A wire locking structure of the present invention comprises a base, at least one conductive terminal lug, and at least one screw.

The base has at least one hole and at least one through-hole. The at least one hole and the at least one through-hole communicate with each other and communicate with the outside of the base. The at least one conductive terminal lug is disposed at the at least one hole of the base. The at least one conductive terminal lug comprises a locking portion and a terminal portion. The locking portion has an internal thread. The terminal portion extends from the at least one hole to the outside of the base. The at least one conductive terminal lug has an aperture. The aperture corresponds in position to and communicates with the at least one through-hole of the base and opens to the internal thread. The at least one screw penetrates the at least one hole of the base so as to be engaged with the internal thread of the locking portion of the at least one conductive terminal lug and screwed into the aperture.

Given the aforesaid structural design, it is feasible to save materials, cut costs, and enhances the wire locking conforming rate.

The at least one conductive terminal lug has a Y-shaped cross-section and is characterized by two position-related features: the locking portion is above the terminal portion, and the aperture is between the locking portion and the terminal portion.

A flange portion is circumferentially disposed at the at least one hole of the base, such that the at least one conductive terminal lug is disposed at the at least one hole and abuts against the flange portion.

A spur portion is protrudingly disposed on each side of the at least one conductive terminal lug in a manner that the spur portions abut against the base.

DETAILED DESCRIPTION OF THE EMBODIMENT OF THE INVENTION

Figure 1:
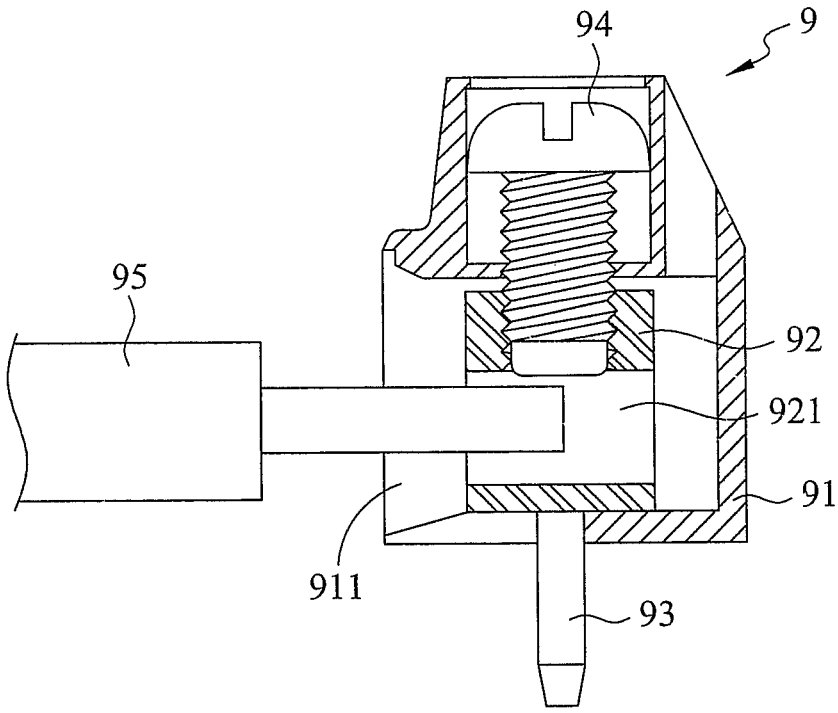
FIG. 1 (PRIOR ART)
FIG. 1 (PRIOR ART) is a cross-sectional view of a conventional wire locking structure.
Figure 2:
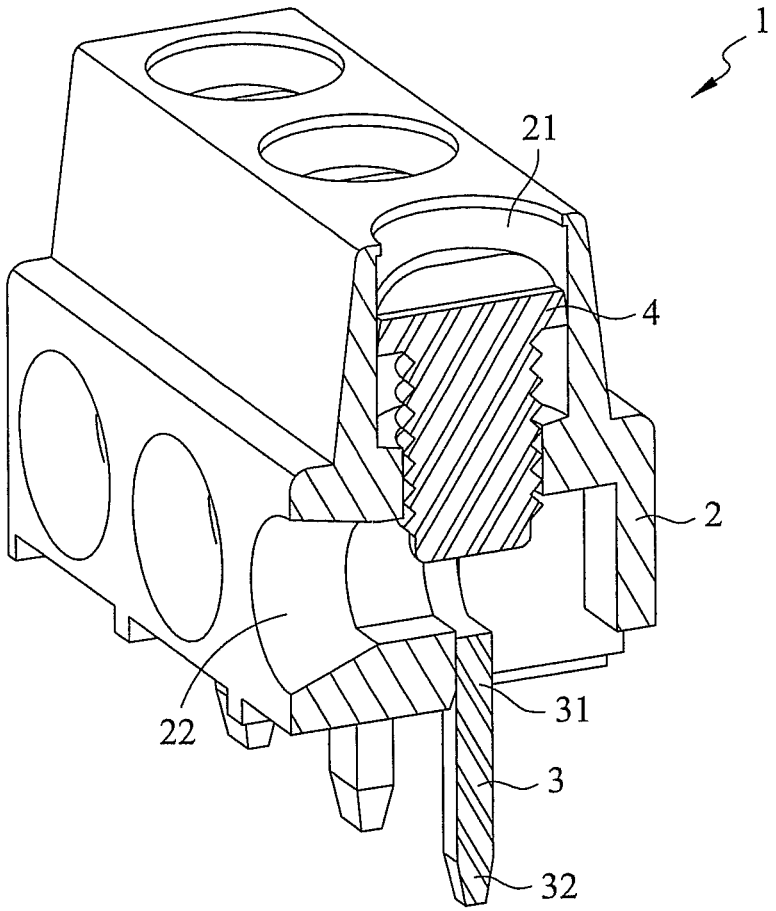
FIG. 2 is a perspective cross-sectional view of the preferred embodiment according to the present invention.
Figure 3:
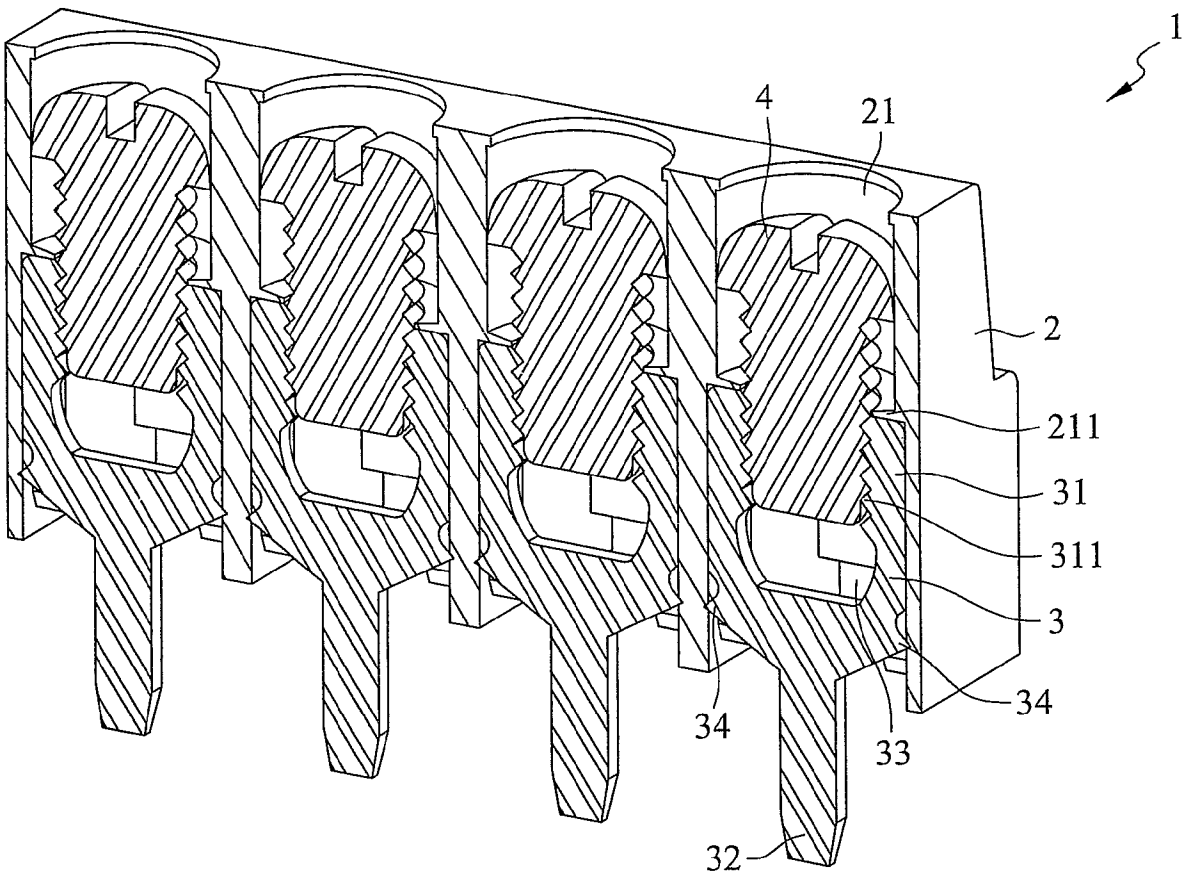
FIG. 3 is a perspective cross-sectional view taken from another view angle of the preferred embodiment according to the present invention.

Referring to FIG. 2 and FIG. 3, there are shown in FIG. 2 a perspective cross-sectional view and in FIG. 3 a perspective cross-sectional view taken from another view angle of the preferred embodiment according to the present invention.

As shown in the diagrams, a wire locking structure 1 comprises a base 2, at least one conductive terminal lug 3, and at least one screw 4.

As shown in the diagrams, the base 2 has at least one hole 21 and at least one through-hole 22. The at least one hole 21 and the at least one through-hole 22 communicate with each other and communicate with the outside of the base 2. The at least one conductive terminal lug 3 is disposed at the at least one hole 21 of the base 2. The at least one conductive terminal lug 3 comprises a locking portion 31 and a terminal portion 32. An internal thread 311 is disposed at the locking portion 31. The terminal portion 32 extends from the at least one hole 21 to the outside of the base 2. The at least one conductive terminal lug 3 has an aperture 33. The aperture 33 corresponds in position to and communicates with the at least one through-hole 22 of the base 2 and opens to the internal thread 311. The at least one screw 4 penetrates the at least one hole 21 of the base 2 so as to be engaged with the internal thread 311 at the locking portion 31 of the at least one conductive terminal lug 3 and screwed into the aperture 33.

Given the aforesaid structural design, it is feasible to save materials, cut costs, and enhances the wire locking conforming rate. The wire locking structure 1 in the preferred embodiment of the present invention is further described below.

Figure 4:
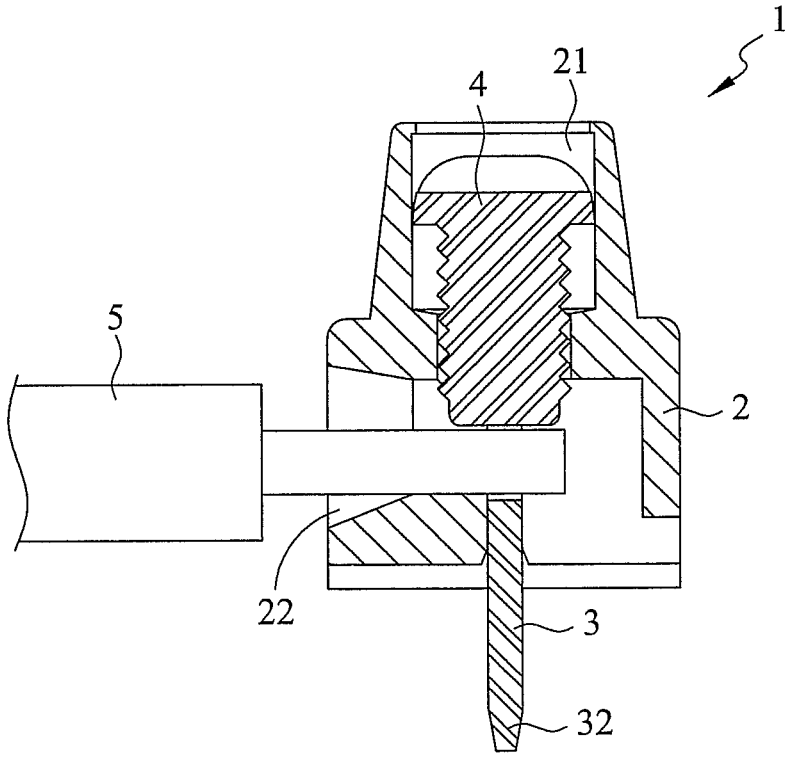
FIG. 4 is a cross-sectional view of the preferred embodiment according to the present invention.
Figure 5:
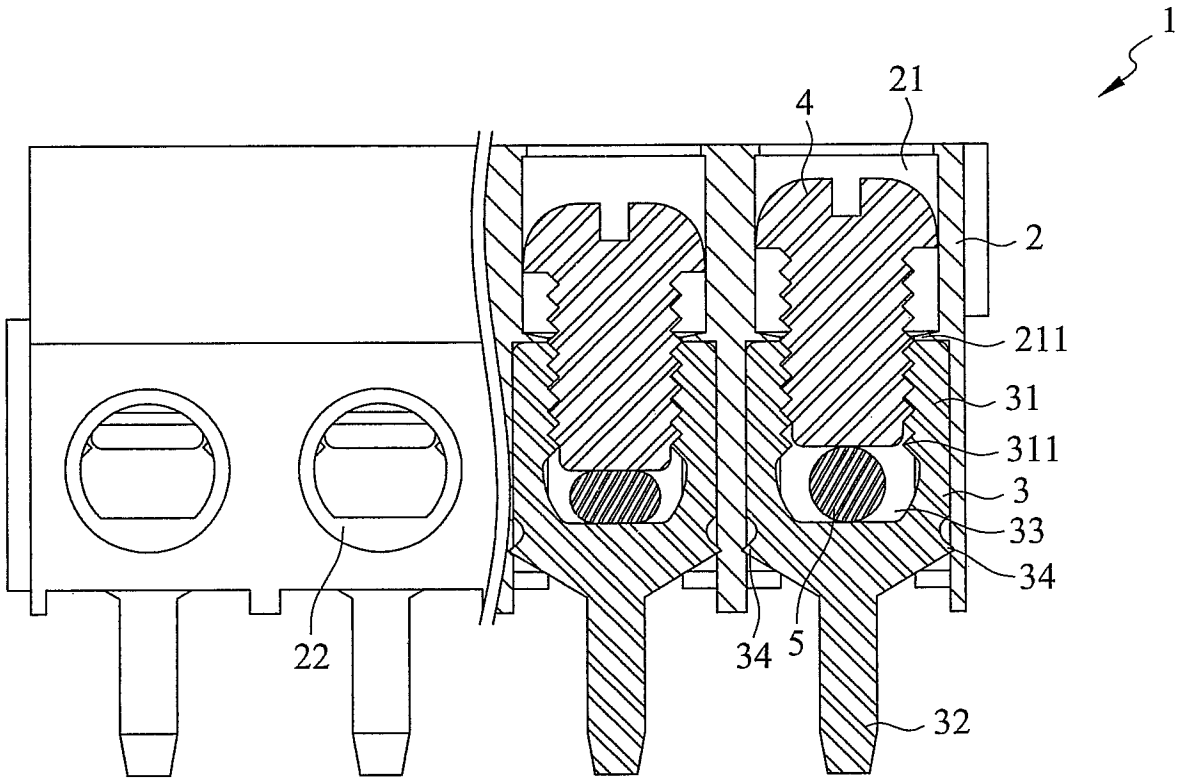
FIG. 5 is a cross-sectional view taken from another view angle of the preferred embodiment according to the present invention.

Referring to FIG. 4 and FIG. 5, there are shown in FIG. 4 a cross-sectional view and in FIG. 5 a cross-sectional view taken from another view angle of the preferred embodiment according to the present invention.

A wire locking process performed with the wire locking structure 1 comprises the steps of: inserting an electrical wiring 5 into the at least one through-hole 22 of the base 2; inserting the electrical wiring 5 into the aperture 33 of the at least one conductive terminal lug 3; and screwing the at least one screw 4 in place. Upon completion of the screwing step of the wire locking process, the at least one screw 4 penetrates the at least one hole 21 of the based 2 and is engaged with the internal thread 311 at the locking portion 31 of the at least one conductive terminal lug 3 and screwed into the aperture 33, and thus the at least one screw 4 is capable of tight-screwing (tightening) the electrical wiring 5.

Hence, as described above, the wire locking process can be performed on the electrical wiring 5 by means of just several parts and components, namely the base 2, the conductive terminal lug 3, and the screw 4, to save materials and cut costs.

Furthermore, the electrical wiring 5 is unlikely to bend and get damaged, because the screw 4 is engaged with the internal thread 311 at the locking portion 31 of the conductive terminal lug 3 and screwed into the aperture 33 to thereby screw tightly (tighten) the electrical wiring 5. Hence, the aforesaid structural design enhances the wire locking conforming rate.

In this embodiment, as shown in the diagrams, the at least one hole 21 of the base 2, the at least one through-hole 22 of the base 2, the at least one conductive terminal lug 3, and the at least one screw 4 are provided in plurality (in the form of a quartet shown in the diagrams), but the aforesaid quantity should not be restrictive of the present invention; on the contrary, they can come in any quantity as needed.

Besides, as indicated by the diagrams, in this embodiment, the conductive terminal lug 3 has a Y-shaped cross-section, and the conductive terminal lug 3 is characterized by two position-related features: the locking portion 31 is above the terminal portion 32, and the aperture 33 is between the locking portion 31 and the terminal portion 32.

Regarding the structural design, a flange portion 211 is circumferentially disposed at the hole 21 of the base 2, such that the conductive terminal lug 3 is disposed at the hole 21 of the base 2 and abuts against the flange portion 211; hence, the conductive terminal lug 3 is firmly disposed at the hole 21.

A spur portion 34 is protrudingly disposed on each side of the conductive terminal lug 3. When the conductive terminal lug 3 is disposed at the hole 21 of the base 2, the spur portions 34 abut against the base 2 to effectuate a fixation effect, such that the conductive terminal lug 3 is firmly disposed at the hole 21 of the base 2.

What is claimed is:

1. A wire locking structure, comprising:

a base having at least one hole and at least one through-hole, wherein the at least one hole and the at least one through-hole communicate with each other and communicate with an outside of the base;

at least one conductive terminal lug disposed at the at least one hole, comprising a locking portion and a terminal portion, and having an aperture, the locking portion having an internal thread, the terminal portion extending from the at least one hole to the outside of the base, the aperture corresponding in position to and communicating with the at least one through-hole and opening to the internal thread; and at least one screw penetrating the at least one hole so as to be engaged with the internal thread and screwed into the aperture, wherein the at least one conductive terminal lug has a Y-shaped cross-section, with the locking portion being above the terminal portion, and the aperture being between the locking portion and the terminal portion.

2. The wire locking structure of claim 1, wherein a flange portion is circumferentially disposed at the at least one hole, such that the at least one conductive terminal lug is disposed at the at least one hole and abuts against the flange portion.

3. The wire locking structure of claim 1, wherein a spur portion is protrudingly disposed on each side of the at least one conductive terminal lug in a manner that the spur portions abut against the base.

4. A wire locking structure, comprising:

a base having at least one hole and at least one through-hole, wherein the at least one hole and the at least one through-hole communicate with each other and communicate with an outside of the base;

at least one conductive terminal lug disposed at the at least one hole, comprising a locking portion and a terminal portion, and having an aperture, the locking portion having an internal thread, the terminal portion extending from the at least one hole to the outside of the base, the aperture corresponding in position to and communicating with the at least one through-hole and opening to the internal thread; and at least one screw penetrating the at least one hole so as to be engaged with the internal thread and screwed into the aperture, wherein a flange portion is circumferentially disposed at the at least one hole, such that the at least one conductive terminal lug is disposed at the at least one hole and abuts against the flange portion.

5. A wire locking structure, comprising:

a base having at least one hole and at least one through-hole, wherein the at least one hole and the at least one through-hole communicate with each other and communicate with an outside of the base;

at least one conductive terminal lug disposed at the at least one hole, comprising a locking portion and a terminal portion, and having an aperture, the locking portion having an internal thread, the terminal portion extending from the at least one hole to the outside of the base, the aperture corresponding in position to and communicating with the at least one through-hole and opening to the internal thread; and at least one screw penetrating the at least one hole so as to be engaged with the internal thread and screwed into the aperture, wherein a spur portion is protrudingly disposed on each side of the at least one conductive terminal lug in a manner that the spur portions abut against the base.

* * * * *